United States Patent [19]

Cummings

[11] Patent Number: 5,014,651

[45] Date of Patent: May 14, 1991

[54] METHOD AND APPARATUS FOR IMPROVING UTILIZATION OF FUEL VALUES OF AS-MINED COAL IN PULVERIZED FUEL-FIRED BOILERS

[75] Inventor: Donald R. Cummings, MacLean, New South Wales, Australia

[73] Assignee: D.U.T. Pty. Ltd., New South Wales, Australia

[21] Appl. No.: 399,117

[22] Filed: Aug. 25, 1989

[30] Foreign Application Priority Data

Aug. 25, 1988 [AU] Australia ..... PJ0113

[51] Int. Cl.[5] ..... F22B 1/02; F23K 3/02

[52] U.S. Cl. ..... 122/4 D; 110/245; 110/106

[58] Field of Search ..... 122/4 D; 110/245, 106, 110/239

[56] References Cited

U.S. PATENT DOCUMENTS

| | | | |
|---|---|---|---|
| 4,182,245 | 1/1980 | Stewart et al. | 110/106 |
| 4,183,330 | 1/1980 | Bryers et al. | 110/245 |
| 4,321,034 | 3/1982 | Taccone . | |
| 4,338,283 | 7/1982 | Sakamoto et al. . | |
| 4,377,119 | 3/1983 | Noack | 110/245 |
| 4,392,438 | 7/1983 | Dooley | 110/106 |
| 4,465,000 | 8/1984 | Shimoda | 110/245 |
| 4,622,904 | 11/1986 | Murphy et al. | 110/245 |
| 4,630,556 | 12/1986 | Schaffee | 110/106 |
| 4,749,133 | 6/1988 | Sayler et al. | 110/106 |
| 4,796,546 | 1/1989 | Herstad et al. | 110/245 |

FOREIGN PATENT DOCUMENTS

| | | |
|---|---|---|
| 2011594 | 7/1979 | United Kingdom . |
| 2034445 | 6/1980 | United Kingdom . |
| 2192141 | 1/1988 | United Kingdom . |

*Primary Examiner*—Henry C. Yuen

*Attorney, Agent, or Firm*—Browdy and Neimark

[57] ABSTRACT

Where as-mined coal or a washed coal derived therefrom is burned in a pulverized coal-fired boiler, improvements both in the utilization of the overall fuel values of the as-mined coal and in the operating efficiency of the boiler are obtained by installing a fluid bed combustor in the same combustion chamber as the pulverized fuel burner system of the boiler, and preferably below the burner system, and supplying as the fuel to the combustor a fuel comprising coal washery tailings preferably mixed with high ash solid washery residue.

18 Claims, 3 Drawing Sheets

METHOD AND APPARATUS FOR IMPROVING UTILIZATION OF FUEL VALUES OF AS-MINED COAL IN PULVERIZED FUEL-FIRED BOILERS

This invention relates to a method and apparatus for improving the utilisation of the fuel values of as-mined coal in pulverised coal fired boilers.

Whilst it is possible to design and operate pulverised coal fired boilers with "as-mined" or "run of mines" coal, that is the total coal containing product from a mine, such coals contain high as coals and non-coal materials such as shales and rocks. These materials can cause difficulties in the coal grinding stage and also a level of ash production within the pulverised coal fired boiler which causes tube fouling and possibly even erosion if gas velocities are high. Ash in the coal may also contain volatile salts which also may cause tube deposits and fouling.

As a result many pulverised coal fired boilers require a washed coal feed in order to reduce the problems associated with using "as-mined" coal.

It is known to wash as-mined coal in a coal washery to produce a fraction, known as "washed coal", whose ash content is lower than that of the as-mined coal. However, two other products also result from washing, namely (a) "solid washery residue" which is coal having an ash content higher than that of the as-mined coal, and (b) very fine coal particles known as "tailings" and which are normally recovered from the washery in the form of a slurry. Thus, coal washing to produce a fuel suitable for use in a pulverised coal fired boiler produces two sources of potential waste, namely the high ash-content material known as coal washery residue, and tailings. The tailings present a particularly intractable disposal problem.

Large integrated coal mining, washery and pulverised fuel boiler based power stations can be nett producers of major amounts of coal wastes which represent a major loss or under-utilisation of coal resources as well as creating severe environmental problems.

With coal washing operations the production of coal waste can represent a loss of energy which, in some instances, exceeds 10% of the total mined energy values. Where the washed coal is used not only for power generation near the washery but also for other uses such as coke production or for power stations remote from the washery, the total level of waste may be even higher.

If an attempt is made to reduce coal wastes by operating with a higher ash content coal this can result in increased maintenance problems with the pulverised fuel grinder due to the more abrasive nature of the coal feed.

These problems may be reduced or overcome in accordance with the present invention by a method comprising the steps of:

(i) supplying as the fuel to a pulverised fuel burner system of the boiler a fuel comprising washed coal, and (ii) supplying as the fuel to a fluid bed combustor in the same combustion chamber as said pulverised fuel burner system a fuel comprising washery tailings.

Normally, the washery tailings will be from the same washery as the washed coal or the washeries will be associated with the same coal field but this is not essential.

In some cases, it has been found that the as-mined coal is of sufficiently low ash content to be used as such as fuel for the pulverised fuel burner system but is not sufficiently pure for other uses. In such cases, the above method can be modified by substituting some or all of the washed coal by as-mined coal. The washed coal can then be used for other purposes.

Preferably the fuel for the fluid bed combustor comprises a mixture of solid washery residue and tailings. As indicated above, the tailings are normally recovered from a washery as a slurry. The solid washery residue may be mixed with this slurry and the product supplied as a slurry to the fluid bed combustor. Alternatively, the slurry may be filtered prior to mixing.

Thus, in one embodiment of the invention, at least a part of a supply of as-mined coal can be washed to produce washed coal, solid washery residue and tailings, the fuel to the pulverised fuel burner system may comprise another part of the as-mined coal before washing, at least a part of the washed coal or a mixture thereof, and at least a part of the tailings, preferably in admixture with at least a part of the solid washery residue, is employed as fuel to the fluid bed combustor.

It will be understood that it may be necessary to grind the solid washery residue prior to employing it in the fuel supply to the fluid bed combustor. Likewise, it will normally be necessary to pulverise the as-mined coal and/or washed coal prior to supplying it as fuel to the pulverised fuel burner system.

The invention also provides apparatus comprising:

(i) a boiler of the kind fired by pulverised solid fuel, said boiler having a fluid bed combustor in the same combustion chamber as the pulverised fuel burner system, (ii) means for supplying to the pulverised fuel burner system of said boiler a fuel comprising as-mined coal, washed coal or a mixture thereof, (iii) coal washing means associated with a coal field for washing as-mined coal to produce washed coal, solid washery residue and tailings, (iv) means for forming a mixture comprising at least a part of said tailings and at least a part of said solid washery residue, and (v) means for supplying said mixture as fuel to said fluid bed combustor.

The coal washing means may comprise a single washery or a plurality of washeries associated with a coal field. In the latter case, it will be understood that the solid washery residue and tailings need not be from the same washery. Likewise, the washed coal employed as fuel to the pulverised fuel burner system need not be from the same washery as the residue and/or tailings or even from a washery associated with the same coal field and the as-mined coal can be from a different coal field.

In one embodiment, however, the washed coal will come from the same coal washing means as the tailings and residue.

In addition to resolving substantial and seemingly intractable problems that have faced the art hitherto concerning the disposal of coal washery waste and especially tailings, it has been found that the present invention also resolves a number of other problems hitherto associated with the use of pulverised coal fired boilers, namely:

the need, where pulverised coal fired boilers are used for power generation and generally have to operate with wide fluctuations in load on an hourly, daily and seasonal variation basis, to consume high grade fuel at the turn down point where the power turbine is held on spinning reserve or where the boiler is held in hot condition, even though no power is generated;

the instability of a pulverised coal flame at low turndown if background temperature and radiation levels do not ensure coal ignition; (Conventionally either the boiler must then be shut down or a supplementary, easily ignited fuel such as oil or gas must be supplied to ensure hot operation and a stable flame.)

the increased maintenance problems arising from the repeated shut down and restart required when burning expensive fuels; (This is because most boiler and allied power generation machinery and equipment generally deteriorates at a faster rate when repeatedly started and stopped as opposed to when it is operated continuously.)

the anticipation of load requirements and the usage of fuel without power generation during the heating period, with the risk that the anticipated load increase which necessitated the heating might not eventuate, which is necessary because restart of boilers and allied equipment such as turbines and pumps generally takes some hours;

the difficulties of superheater and reheater temperature control with pulverised fuel boilers; (This is because superheater outlet temperature control is often achieved by varying not only the rate of coal feed but also the direction of the coal flame in the radiant zone of the boiler. It can be difficult to ensure maintenance of the desired superheater temperature control when operating at low load.)

the problem, where steam reheating is used with the reheater tube bank masked by the superheater tubes, of proportioning heat to both superheater and reheater tube banks to maintain a controlled temperature from full load to maximum turndown; (Sometimes it may be necessary in order to maintain a minimum temperature level from the reheater to exceed the design temperature leaving the superheater. In this case the boiler pressure may have to be reduced so as not to exceed the design creep stress levels in the superheater tubes.)

the failure, where boilers have single induced or forced draft fans, of either the forced or induced fan - which failure automatically means a boiler shutdown.

Due to variable loads and the problems mentioned above it is not uncommon for major power stations connected to power grids to operate at an average of as low as 20 to 30% of capacity and have availability figures below 80% and in some instances as low as 60%. These figures are very poor when compared with major process plants such as ore roasters, blast furnaces, oil refineries etc which operate continuously and which typically have availability figures in excess of 90%.

The boiler may be operated at high load in its design configuration of a pulverised coal fired boiler and at lower loads with partial or total use of the fluidised bed combustor using waste coal.

By means of the invention, a significant part of the boiler's normal fuel requirement when operating over a wide range of power outputs is supplied by coal wastes generated by the washing of coal to produce low ash coal for use as pulverised coal in the said boiler or for use separate to the said boiler, or from a combination of these two outlets for low ash coal.

Other advantages of the invention are:

for a given output of power, less low ash coal will be required by the boiler and the balance may be diverted for sale or to other uses;

the generation of environmentally undesirable coal wastes from supplying coal to the boiler or from supplying low ash coal to other outlets may be reduced and possibly eliminated;

at low boiler load the heating of the boiler may be carried out solely by the fluid bed combustor with the fluid bed combustor providing a stable combustion temperature at low load;

the boiler and allied steam turbine and ancilliary equipment can be kept running at low or zero load or held in a hot condition by the use of coal wastes as fuel, thus eliminating the need to burn valuable high grade coal under conditions of very low or zero thermal efficiency;

the boiler can be kept in continuous operation substantially eliminating the need for stopping and restarting the boiler and ancilliary equipment for fuel economy reasons thus eliminating the maintenance problems and cost resulting from such stopping and restarting;

the arrangement enables the use as fuel of tailings which could not normally be used in fuel supply to a pulverised coal fed boiler;

the particle size to which the solid washing residue needs to be crushed for use in the fluid bed combustor may be considerably coarser than that required for pulverised fuel combustion thus significantly reducing the grinding problems associated with converting this low grade fuel to a form suitable for use as part of the pulverised fuel;

the boiler may be maintained in a hot or partial load condition by the fluid bed combustor in the event of a failure of the pulverised coal fuel or combustion air systems. Where a natural draught effect is available from the boiler to ensure a reduced gas flow through the boiler the fluid bed combustor may also be used to maintain the boiler in a hot or low load condition in the event of an induced draught fan failure.

The fluid bed combustor may be designed to provide from 5% up to 100% of the design heat load of the boiler but is more preferably designed to provide from 10 to 50%.

The pulverised fuel burner system may comprise a single burner or a plurality of burners and in practice generally comprises an array of burners located at several locations around the walls of the combustion chamber and/or vertically within the combustion chamber.

Preferably, the fluid bed combustor is located below the pulverised fuel burner system in the combustion chamber.

With this embodiment:

the pulverised coal can be ignited on the fluid bed combustor and at low pulverised fuel rates the fluid bed combustor will ensure suitably stable flame conditions;

when the pulverised coal flame is operated at very low rating and the fluidised bed is used to ensure a stable flame, incompletely combusted coal from the pulverised coal flame falling from the flame can be finally combusted within the fluidised bed;

where a whole or part of the superheating and/or reheating of the steam from the boiler is carried out within the fluid bed combustor, the superheater and reheater temperatures can be controlled by conditions controllable within the fluid bed section of the boiler separate from the limitations of heat transfer and heat transfer control above the pulverised fuel combustion zone of the boiler;

the combustion chamber can be constructed and arranged such that during the operation of the pulverised coal combustor, the ash from the pulverised coal dropping out in the combustion zone of the boiler can be directed into the fluidised bed and thus discharged via the ash discharge system associated with the fluidised bed;

when pulverised fuel only is used and no conflicting heating requirements are required within the fluidised bed, heat exchange may be effected in a fluidisation zone of the fluid bed combustor between the ash discharged from the combustion zone and at least a part of the combustion air to the pulverised fuel burner system whereby to cool the latter and pre-heat the former. By a fluidisation zone is meant the zone occupied by fluidisable material on fluidisation;

part of the superheating and reheating of the steam may be located in the radiant zone of the boiler and the remaining reheating and superheating of the steam conducted in the fluidised bed zone;

by placing the fluidised combustor in the lower part of the combustion chamber the pulverised coal burner can supply heat to the fluidised bed by radiation and may also provide part of the fuel for the bed when the flame is directed towards the fluidised bed;

for a given rating of the boiler the ash carryover to the convection zone of the boiler will be less than the amount of ash which would be carried over if the higher ash coal fraction employed as fuel to the fluid bed combustor were to be burned as pulverised fuel;

the separation of the as-mined coal into low ash washed coal and high ash washery residue and the use of he latter in the fluid bed also reduces the throughput of non-coal abrasive materials being fed to the pulverised coal grinders;

the fluid bed combustor may be operated with a deficiency of air in order to minimise bed velocities and to control bed temperature by endothermic gasification primarily producing carbon monoxide. The combustible gases leaving the fluidised bed may be finally combusted by the addition of excess air to the pulverised fuel flame zone.

The fluid bed combustor may be divided into a plurality of separate sections each section having its own separately controlled fluidisation air supply. With this embodiment, individual sections may be shut down or reduced to the point of incipient fluidisation. Where the overall arrangement is such that ash from the pulverised coal falls onto a fluidised bed comprising a plurality of sections some of which are shut down or reduced to the point of incipient fluidisation, ash falling into such sections may cone and then fall into adjacent fluidised sections thus continuing to allow discharge of ash from the main combustion chamber and at the same time allowing fluid bed control by partial shut down of individual sections.

Where the boiler includes steam reheat and/or steam superheat facilities and the fluid bed combustor is divided into a plurality of sections, at least one section may contain superheater and/or reheater tubes in its fluidisation zone and at least another section may be devoted solely to combustion. Fuel feed may be included in all sections but in a preferred embodiment fuel feed is supplied only to the tube-free section or sections.

The heat transferred to tubes in the fluidised bed may be controlled by varying the temperature of combustion within the fluidised bed and/or shutting down or restarting sections of the fluidised bed. In addition where the combustion occurs only in tube-free sections of a sectioned bed the mass transfer to and the temperature of the fluid bed in the sections containing the tubes may be controlled by varying the height that the fluid bed submerges the partition between the combustion and tube-containing sections of the fluidised bed.

Where the fluidised bed is divided into combustion sections and separate tube-containing sections separated by dividing walls, the height of the fluidised bed above the dividing walls between the sections may be varied to regulate the mass and heat and combustible fuel flow to and the temperature of the tube-containing section or sections thus permitting greater control of the superheated or reheated steam in the said tubes.

The percentage of heat supplied by the fluid bed combustion is variable over a wide range but a preferred percentage capable of transfer in the fluid bed would be equivalent to about 10 to 30% of the superheater and reheater input at rated load for the boiler.

By means of this invention existing pulverised coal fired boilers may be fitted with fluid bed combustors thus enabling existing boilers to use waste coal as a significant part of their fuel load thus eliminating the normal time lag required with conventional fluid bed combustion boilers which could only be constructed as the demand for additional boilers was generated.

If desired, at least two fluid bed combustors, arranged one above the other, may be located in the combustion chamber, with each bed above the lowest having passage means for the passage upwards therethrough of gas from a lower bed.

Where the boiler includes steam reheat and/or steam superheat means, at least a part of said reheat and/or superheat may be provided by a further fluid bed combustor outside the combustion chamber.

The invention will now be described in more detail with reference to preferred embodiments thereof and with the aid of the accompanying drawings in which.

Figure 1:
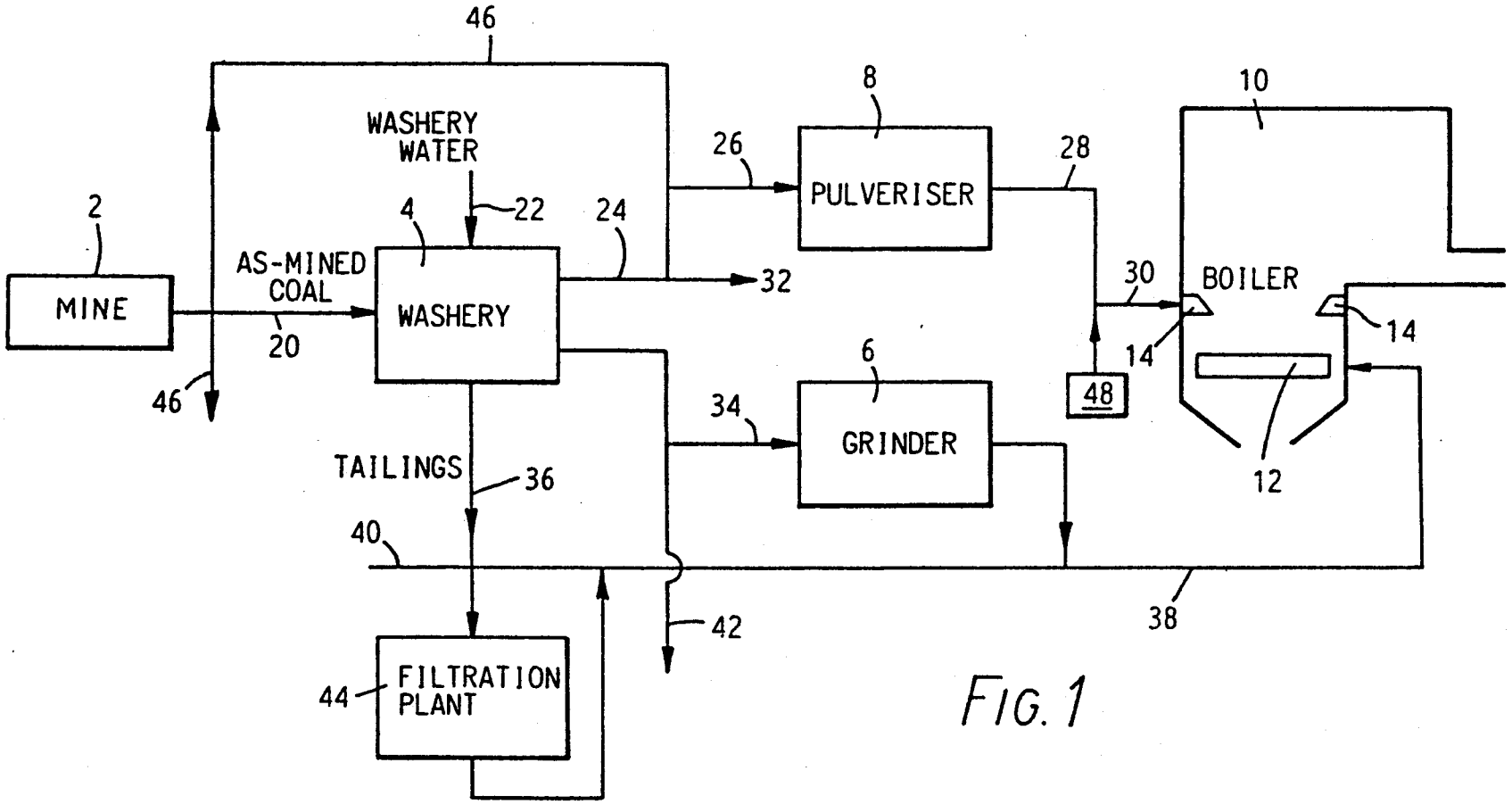
FIG. 1 is a schematic flow diagram of one arrangement according to the invention.

Referring to FIG. 1, 2 represents a coal mine, 4 a coal washery, 6 a grinder, 8 a pulveriser and 10 is a boiler of the kind fired by pulverised solid fuel but modified to include a fluid bed combustor 12 in the same combustion chamber as the pulverised fuel burner system 14. In the embodiment shown, the fluid bed combustor is shown in the preferred location below the pulverised fuel burner system, but that is not essential.

In one aspect of the invention, at least some of the as-mined coal recovered from mine 2 is transferred by a conveyor or other suitable means 20 to coal washery 4 supplied with washer water by means 22. In the washery, the coal is separated into low ash washed coal recovered at 24 which is suitable for use as fuel in pulverised fuel burner system 14 of the boiler 10. At least a part of the washed coal is transferred by any suitable means 26 to pulveriser 8 where it is pulverised to the particle size required for injection into the pulverised fuel burner system. The pulverised material is then transferred via duct 28 for injection into the burner. If desired, however, e.g. where the washed coal available from the washery exceeds boiler demand, some of this low ash portion can be removed from the system as at 32 for sale or use elsewhere.

Also recovered from the washery 4 are a high ash washery residue, recovered at 34, and a slurry or suspension of very fine coal particles, termed tailings recovered at 36. In accordance with the invention, at least a portion of the washery tailings, are supplied as fuel to the fluid bed combustor 12 via 38.

If desired, a part or all of the washery residue, after grinding to a suitable size in grinder 6 if necessary, is mixed with the tailings to provide the fuel to the fluid bed combustor. Any excess tailings and/or washery residue can be disposed of, as at 40, 42, respectively, e.g to waste.

The tailings can be supplied int he form of a slurry as recovered from the washery 4 or they may first be filtered in filtration plant 44. In the former case the fuel supply means to the fluid bed combustor may be a slurry feed system. In the latter case, a dry feed system may be used.

Where the as-mined coal has a sufficiently low ash content, the pulveriser for the fuel burner system may be supplied with as-mined coal as shown at 46 instead of washed low ash material and all the low ash material may be used elsewhere or sold. Alternatively,, the pulveriser may be fed with a combination of as-mined coal and washed coal from the washery.

In yet another alternative, part or all of the fuel supply to the pulverised burner system may comprise as-mined coal or washed coal from another source 48.

Figure 2:
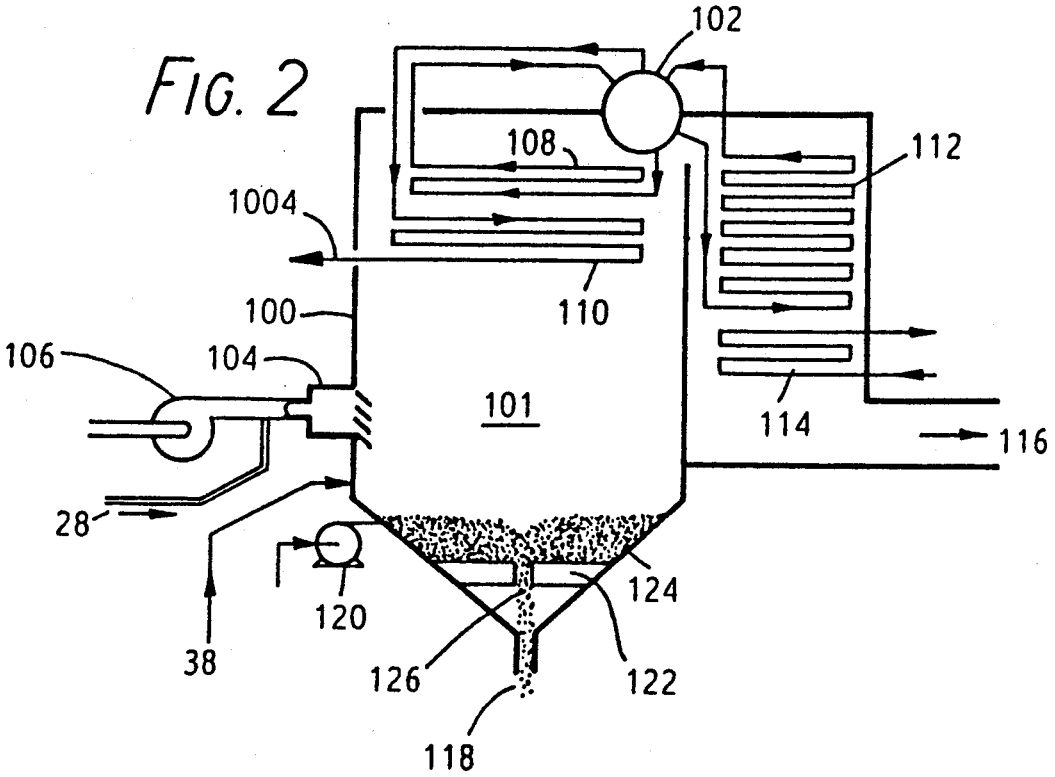
FIG. 2 is a diagrammatic cross-sectional elevation of a modified pulverised fuel fired boiler for use in the invention.

FIG. 2 shows, in simplified and diagrammatic form, a modified pulverised fuel-fired boiler suitable for use as boiler 10 in the arrangement of FIG. 1. The boiler, represented generally by reference numeral 100, comprises a radiant combustion zone 101, boiler steam drum 102, pulverised fuel burner 104 of a pulverised fuel burner system, boiler tube bundle 108, superheater steam bundle 110, convection zone boiler tube bundle 112 and feedwater heater tube bundle 114. Pulverised coal for the burner 104 is supplied through duct 28 and injected by an air draught provided by air fan 106. The hot combustion gases exit through exhaust duct 116 which leads to a conventional combustion gas discharge system comprising extraction fans, duct removal equipment and other gas cleaning means. Ash discharge is via 118. Other pulverised fuel burners, additional air fans, induced draught fans, air and combustion gas valves and like ancillary items are omitted for the sake of clarity.

For use in the invention, the boiler is additionally provided in the combustion chamber with a fluid bed combustor comprising combustion/fluidising air chamber or ducting system 122 and fluidisable combustion bed 124. Fuel feed to the bod is via feed pipeline 30 and air under pressure for fluidisation of the bed is supplied by fan 120. Ash discharge from the bed is by means of ash discharge system 126. Feed pipeline 38 may be a slurry feed pipeline or a solid feed pipeline.

The fluid bed combustor is of conventional kind and thus the feed and air admission systems and air and fuel controls, etc, are not shown in any detail.

In the arrangement shown in FIG. 2, the superheated steam leaving the boiler via pipeline 1004 is controlled by conventional means by control of the pulverised coal burner. Supplementary heating during normal operation may be provided by the fluidised bed combustor. When the boiler output drops below the point where the associated turbine cannot be operated under load the fluidised bed combustor may be used to maintain the boiler in a hot condition and possibly to maintain the turbine in a hot spinning standby condition.

Figure 3:
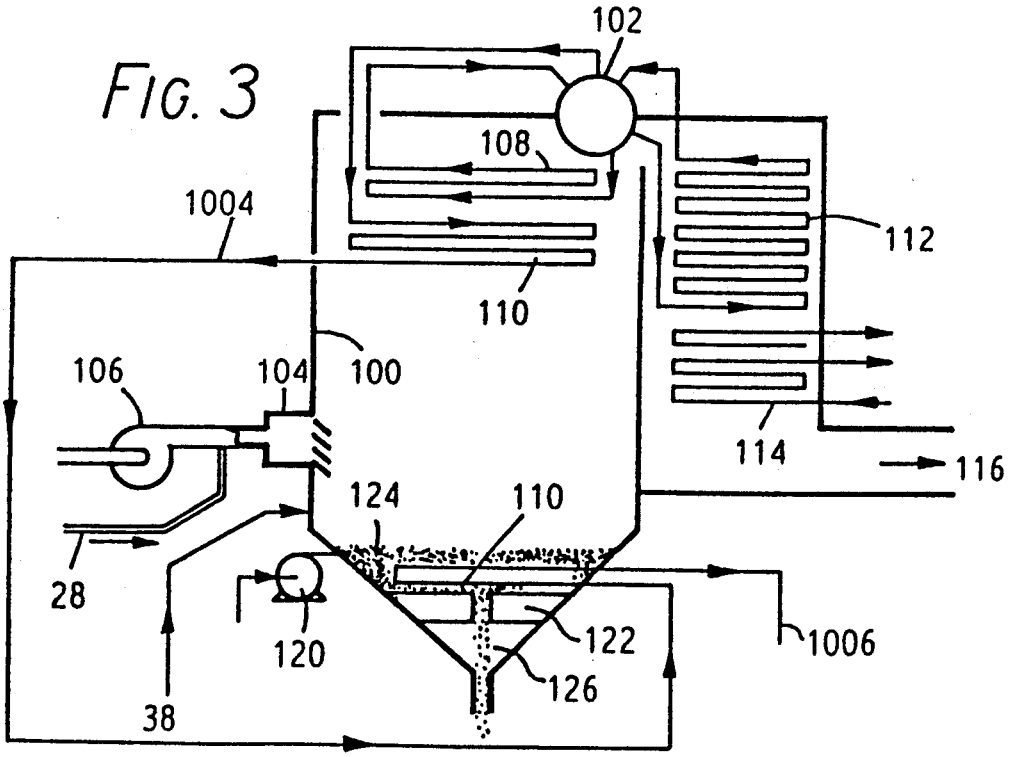
FIG. 3 shows a boiler similar to that of FIG. 1 but with superheater tubes located in the fluidisable zone of the fluid bed combustor.

FIG. 3 shows a variation of the arrangement shown in FIG. 2 wherein part of the superheater surface is installed in the fluidisable zone of the fluid bed combustor. Superheated steam leaving the radiant zone superheater tube bundle via pipeline 1004 passes to an additional tube bundle 118 in the fluid bed combustor before leaving via the pipeline 1006.

In this case the fluidised bed may contribute a significant part of the superheater load and the size of the superheater tube bundle in the radiant zone 101 may be reduced accordingly.

In this case superheater temperature control is possible by a combination of both pulverised coal burner control and fluidised bed combuster control. In addition when the boiler is at low load using the fluidised bed combustor only, the fluidised bed can provide the necessary degree of superheating to the steam and allow the associated turbine to operate down to very low power outputs as well as being able to provide a high degree of turbine temperature control when the turbine is operating in hot spinning standby mode.

Figure 4:
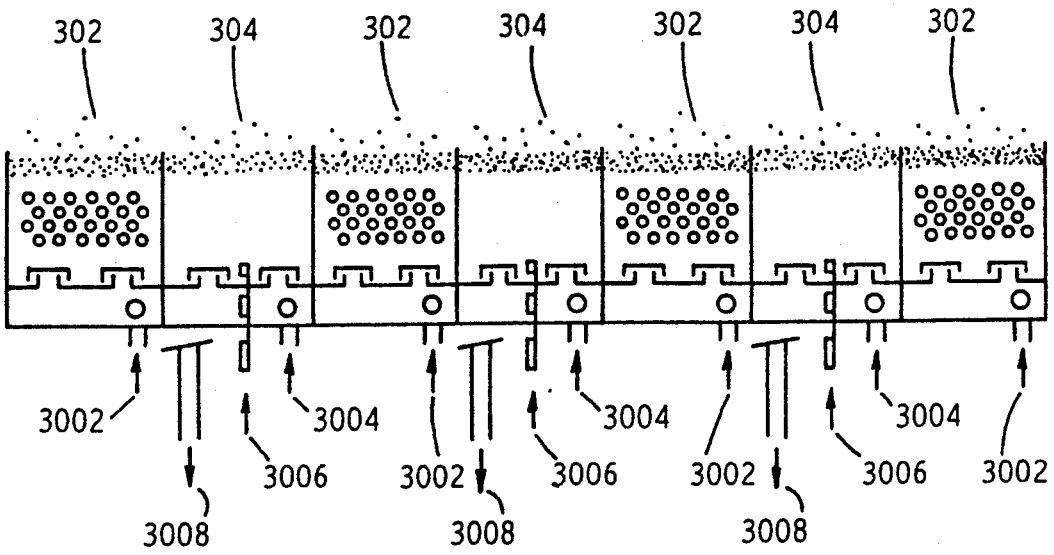
FIG. 4 is a diagrammatic cross-sectional elevation of one possible fluid bed combustor arrangement where the combustor comprises a plurality of sections some with superheater tubes and some without.
Figure 5:
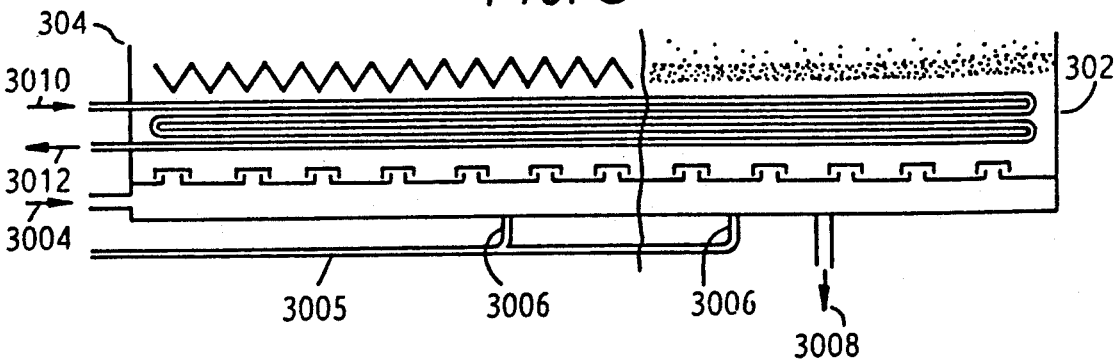
FIG. 5 in a diagrammatic cross-sectional elevation of a tube-containing section of the arrangement shown in FIG. 3, taken at right angles to FIG. 3 and part cutaway to show the section behind it.

FIGS. 4 and 5 show a preferred embodiment of the fluidised bed combustor section of the boiler in more detail. The fluidisable bed comprises a plurality of longitudinal sections. Seven are shown in the drawings but more or less than seven may be present. Four of these sections, identified by reference numeral 302, comprise fluidisable beds containing superheater tubes. The remaining three sections 304 are fluidised combustor sections containing coal slurry feed and ash removal systems. Coal feed other than as slurry would also be possible.

Materials of construction currently used for fluid bed combustors, e.g. ceramic protected mild steel, heat resistant alloys and other materials well known to those skilled in the art of fluid bed combustor design, may be used as the materials of construction for the fluid bed combustor shown.

In each of sections 302, a superheater tube bundle is installed with steam entering via pipeline 3010 and leaving via pipeline 3012. Fluidising/combustion air suitably compressed is admitted via pipeline 3002 and passes to a series of bubblecap distributors below the fluidised bed. Other forms of ductwork and air distribution are also possible.

In each of sections 304 combustion air suitably compressed is similarly admitted via duct 3004 and passes to series of bubblecap distributors below the fluidised bed.

Other forms of ductwork and air distribution are also possible.

Coal waste slurry is fed to each section 304 via a pipeline 3005 which distributes the slurry to injector pipes 3006. Each section 304 is also fitted with a state of the art ash overflow/removal system which can maintain the fluidised bed surface level at a predetermined and controllable level. The outlet from this system is via duct 3008 shown as a single outlet but which may be a multiple of pipes or a specially shaped duct.

FIG. 5 shows one possible form of dividing wall between sections 302 and 304. The top of the dividing wall is shown to have a sawtooth profile. The purpose of this profile is to give a more gradual variation of control over cross mixing of the bed materials per unit of bed height variation. The top of the dividing wall may also be straight and horizontal, however.

With this arrangement of the fluid bed combustor, the control of the superheater steam temperature may be by one, or a combination, of the following: temperature control in the combustor sections 304, control of the level of the fluid bed above the walls dividing sections 302 and 304, control of the amount of fluidising/combustion air passing through sections 302 and the possible stopping of fluidisation in one or more of sections 302.

Where the interflow of material and hence fuel between sections 302 and 304 is reduced there will be a drop in temperature in sections 302 compared with sections 304. It will be realised that further divisions within the overall fluid bed are possible such that the various 304 sections as well as the 302 sections may be operated at different temperature levels.

Where the flow of bed material between sections 302 and 304 is restricted a further control of temperature in section 302 may be achieved by varying the rate of air excess to combustion needs through the bed.

Removal of any large particles and agglomerates from the fluid beds can be affected by means well known in the art and therefore is not shown.

Provision for heating and control of reheating steam from power turbines has not been discussed but the means of achieving this will be obvious from the range of control techniques described above in connection with superheated steam.

The invention is further illustrated by the following Examples.

EXAMPLE 1

2000 tonnes/day of washed coal having an average ash content of 15% and a calorific value of 28.45 MJ/kg and suitable for use as fuel to a pulverised fuel boiler can be obtained by washing 2667 tonnes/day of coal having an average 25% ash content and a calorific value of 25.10MJ/kg.

667 tonnes/day (dry basis) of a combination of tailings and solid washery residue having a heating value of 15.06 MJ/kg are produced as waste from the coal washery.

920 tonnes/day of the washed coal are required as fuel for a pulverised coal fired power station having a rated capacity of 150 MW and a mean power output of 100 MW. The remaining washed coal (1080 tonnes/-day) is available for export.

When the pulverised coal fired boiler of the power station is fitted with a fluid bed combustor having a power equivalent rating of 40 to 50 MW in the same combustion chamber as the pulverised fuel burner system, the fluid bed combustor can consume the entire 667 tonnes per day waste production from the washery in the form of a 60% by weight solids/40% by weight water slurry and produce 36 MW of power. The balance of 64 MW required from the pulverised fuel burner system can be achieved with the consumption of 626 tonnes/day of washed coal, thus releasing a further 294 tonnes/day for export.

Thus, the amount of washed coal made available for alternative use or sale is increased by more than 27%.

EXAMPLE 2

An existing 30 MW rated pulverised coal fired boiler operating at 4140 kPa producing 37.8 kg/second of superheated steam at 454° C. has fitted into the lower section of its combustion chamber a fluidised bed combustor and superheater tube assembly of the kind illustrated in FIGS. 4 and 5 except that the dividing walls have a straight horizontal top surface, not a sawtooth profile.

The fluid bed has an overall dimension of 4.3×4.3 meters and is divided into 7 sections,4 of the sections containing superheater tube bundles and 3 sections without superheater tubes. Each section is 0.6 m wide×4.3 m long.

The total steam flow is divided into 4 parallel paths one per tube bundle.

Each tube bundle consists of 48 tubes arranged in 6 tubes wide by 8 rows deep of tubes arranged in staggered pitch. Steam flow is via 12 tubes in parallel making 4 passes through each bed.

Each tube bundle is 4.1 m long and 0.6 m deep by 0.55 m wide overall.

The distance from the top of the tube bundles to the top of the bubble cap air outlets is 0.8 m. The distance from the top of the tube bundle to the top of the dividing walls is 0 1 m and the fluid bed is capable of being operated up to 0.4 m above the top of the tube bundle.

The total air supply to the fluid bed combustor assembly is 12 $Nm^3$ per second at a pressure of 120 kPa. Valves and suitable flow measurement devices distribute the air between the 7 sections.

With a fluid bed combustor and superheater assembly of these dimensions the fluid bed is capable of providing 25% of the total heat load to the boiler at rated boiler output and 25% of the total superheat required at rated output when operating on a fuel comprising a mixture of solid washery residue and tailings from a coal washery.

With the pulverised fuel system shut down the fluidised bed combustor is capable of firing the boiler and maintaining the design superheater temperature at up to 25% of rated load.

By stopping fluidisation in sections of the fluid bed combustor it is also possible to operate the boiler with stable combustion and control of superheater conditions down to 5% of the rated output of the boiler.

EXAMPLE 3

A conventional pulverised fuel fired boiler having a nominal 100 MW power rating and having an oversized superheater with staged desuperheating and a heat release rating of 300 MW, has main combustion chamber dimensions of 10.0 m by 8.2 m internal cross-section and 26.0 m height from internal roof of the chamber down to the start of the ash hopper section.

The boiler is fitted with 4 conventional pulverised fuel grinders and 4 pulverised coal burner units one in each corner of the combustion chamber with each unit consisting of 4 burners mounted vertically one above the other between 4.5 and 7.5 m above the ash hopper section.

A fluid bed combustor is installed immediately above the ash hopper section and has a horizontal cross-section dimension of 9.6 m by 7.8 m and an operating bed depth of 1.0 m. It is fed at 6 points, namely 3 feed points down each side, with a coal waste slurry feed at such a rate as to maintain a bed temperature of 900° to 1,000° C. Fuel characteristics are as follows:

Water content: 40% wt/wt
Total coal+ash: 60% wt/wt
Ash content: 53% wt/wt (dry basis)
Heating value: 7604 KJ/kg The fuel slurry is produced from a metallurgical grade coal washery and comprises solid washery residue crushed to a maximum 12 mm particle size combined with a mixture of thickened and filtered tailings.

Combustion air is supplied from a 250,000 $Nm^3$/hr air fan supplying air at 20 kPa via a valve and manifold system.

The boiler is capable of operating in the following modes and ratings:

(1) with up to 60 MW heat release from fluid bed combustor and the remainder with pulverised fuel firing at 180 MW heat release rating giving a total heat release of 240 MW or about 80 MW of power rating;

(2) with as low as 15 MW heat release from pulverised fuel firing and the remainder from fluid bed firing at 105 MW heat release giving a total 120 MW of heat release or about 40 MW of power rating.

The pulverised fuel burner system could not be operated at as low as 15 MW heat release without the fluid bed combustor because it would become unstable.

At heat release ratings up to as high as 105 MW, combustion may be from the fluid bed combustor only, if desired.

What is claimed is:

1. A method of improving the utilization of the fuel values in as-mined coal in the production of steam in a pulverized coal fired boiler, said method comprising the steps of:

(i) providing a coal-fired boiler having a combustion chamber for the combustion of pulverized coal and a pulverized fuel burner system in said combustion chamber for the burning of pulverized coal in said combustion chamber:

(ii) providing a fluidized bed combustor in said combustion chamber;

(iii) supplying as the fuel to said pulverized fuel burner system a pulverized fuel selected from the group consisting of pulverized as-mined coal, pulverized washed coal and mixtures thereof, and (iv) supplying as the fuel to said fluidised bed combustor a fuel comprising coal washery tailings.

2. A method as claimed in claim 1 in which the fuel to the fluid bed combustor comprises a mixture of said washery tailings and solid washery residue from a coal washery.

3. A method for improving the utilization of fuel values in as-mined coal in a pulverized coal fire boiler having a combustion chamber for the combustion of pulverized coal, a pulverized fuel burner system in said combustion chamber for the supply of pulverized coal to said chamber for combustion therein, and a fluidised bed combustor in said chamber, the method comprising the steps of:

providing as-mined coal;

washing at least a first part of said as-mined coal to produce washed coal, solid washery residue and tailings, providing a first fuel to the pulverized fuel burner system wherein said fuel comprises a second part of said as-mined coal, at least a part of said washed coal or a mixture thereof, and providing a second fuel to said fluidised bed combustor in the combustion chamber as said pulverized fuel burner system, said second fuel comprising at least a part of said washery tailings or a mixture of said washery tailings with at least a part of said solid washery residue.

4. Apparatus for improving the utilization of fuel values in as mined coal in a pulverized fuel fired boiler, said apparatus comprising:

(i) a boiler of the kind fired by pulverized solid fuel, said boiler having a combustion chamber, a pulverized fuel burner system, and a fluidised bed combustor in the same combustion chamber as the pulverized fuel burner system, (ii) means for supplying to the pulverized fuel burner system of said boiler a fuel comprising as-mined coal, washed coal or a mixture thereof, (iii) coal washing means associated with a coal field for washing as-mined coal to produce washed coal, solid washery residue and tailings, (iv) means for forming a mixture comprising at least a part of said tailings and at least a part of said solid washery residue, and (v) means for supplying said mixture as fuel to said fluidised bed combustor.

5. Apparatus as claimed in claim 4, further including means for supplying at least a part of said washed coal from said coal washing means as fuel to said pulverised fuel burner system.

6. Apparatus as claimed in claim 4 wherein said fuel supply measn for said pulverised fuel burner system includes fuel pulverising means.

7. Apparatus as claimed in claim 4 further including means or grinding said solid washery residue.

8. Apparatus as claimed in claim 4 wherein the fluidised bed combustor is below the pulverised fuel burner system.

9. Apparatus as claimed in claim 8 in which the boiler is constructed and arranged such that ash from the pulverised fuel burner system is removable by means of the ash removal means for the fluidised bed combustor.

10. Apparatus as claimed in claim 8 having means for preheating combustion air for the pulverised fuel burner system by heat exchange with ash from the pulverised fuel burner system in a fluidisation zone of the fluidized bed combustor.

11. Apparatus as claimed in claim 4 wherein the boiler includes at least two fluidized combustors arranged one above the other and passage means in each bed except the lowest for the passage upwards therethrough of gas from a lower bed.

12. Apparatus as claimed in claim 4 wherein the rating of the fluidized combustor is not more than 50% of the rating of the pulverised fuel combustor system.

13. Apparatus as claimed in claim 4 wherein the rating of the fluidized bed combustor is in the range of 15 to 30% of the rating of the pulverised fuel combustor system.

14. Apparatus as claimed in claim 4 wherein the boiler includes means for reheating steam and at least a part of said reheating means comprises at least one tube within a fluidisation zone of the fluidized bed combustor.

15. Apparatus as claimed in claim 4 wherein the fluidized bed combustor includes a fluidisable bed which comprises at least two sections and means for providing a separately controllable supply of fluidising gas to each section.

16. Apparatus as claimed in claim 14 wherein the fluidized bed combustor includes a fluidisable bed which has at least two sections and means for providing a separately controllable supply of fluidising gas to each section, and wherein the fluidisation zone of at least one of said sections contains steam reheat tubes and at least another of said sections includes means for the supply of fuel thereto and is free of steam reheat tubes in its fluidisation zone.

17. Apparatus as claimed in claim 4 wherein the boiler includes means for reheating steam and wherein at least part of said means includes a further fluidized bed combustor outside said combustion chamber.

18. Apparatus as claimed in claim 4 for use with coal containing sulfur and further including means for feeding limestone or dolomite to the fluidized bed combustor.

* * * * *